US008469142B2

(12) United States Patent
Feng

(10) Patent No.: US 8,469,142 B2
(45) Date of Patent: Jun. 25, 2013

(54) MUFFLER ASSEMBLY

(76) Inventor: Zhanzhao Feng, Yagoona (AU)

( * ) Notice: Subject to any disclaimer, the term of this patent is extended or adjusted under 35 U.S.C. 154(b) by 0 days.

(21) Appl. No.: 12/375,934

(22) PCT Filed: Aug. 7, 2007

(86) PCT No.: PCT/AU2007/001110
§ 371 (c)(1),
(2), (4) Date: Nov. 23, 2009

(87) PCT Pub. No.: WO2008/017112
PCT Pub. Date: Feb. 14, 2008

(65) Prior Publication Data

US 2010/0071992 A1 Mar. 25, 2010

(30) Foreign Application Priority Data

Aug. 7, 2006 (AU) ..... 2006904273

(51) Int. Cl.
*F01N 1/00* (2006.01)
*F01N 1/08* (2006.01)

(52) U.S. Cl.
USPC ..... 181/254; 181/264; 181/270; 60/324

(58) Field of Classification Search
USPC ..... 181/254, 264, 270; 60/324
See application file for complete search history.

(56) References Cited

U.S. PATENT DOCUMENTS 1,613,322 A * 1/1927 Goetz ..... 181/254
1,709,426 A * 4/1929 Beery ..... 181/254
1,840,082 A * 1/1932 Breer ..... 181/254
2,138,510 A * 11/1938 Rauen ..... 181/273
2,157,030 A * 5/1939 Starkweather et al. ..... 181/254
3,201,207 A * 8/1965 Lentz ..... 422/112
3,260,566 A * 7/1966 Fisher ..... 423/212

(Continued)

FOREIGN PATENT DOCUMENTS

GB 1354752 5/1974
GB 2254883 10/1992

(Continued)

OTHER PUBLICATIONS

International Search Report Dated Oct. 3, 2007, for corresponding application PCT/AU2007/001110.

(Continued)

*Primary Examiner* — David Warren
*Assistant Examiner* — Christina Russell
(74) *Attorney, Agent, or Firm* — Alston & Bird LLP

(57) ABSTRACT

The invention provides a muffler assembly (10) for exhaust gas flow communication with an engine exhaust. The assembly (10) includes a muffler (12) having inlet and outlet ports (14, 16). The assembly (10) also includes first and second flow of passages in common fluid communication with the outlet port (16) and in variable fluid communication with the inlet port (14). The first and second flow passages meet at first and second connecting points. The first connecting point is located in the proximity of the inlet port (14). The first flow passage has a higher resistance to fluid flow than the second flow passage. The assembly (10) also includes a valve means (24) generally located past the first connecting point inside the second flow passage for selectively proportionating exhaust gases passing through the passages. The first flow passage includes three or more conduits (26, 28, 30) being in fluid communication with each other.

20 Claims, 8 Drawing Sheets

U.S. PATENT DOCUMENTS

| | | | | |
|---|---|---|---|---|
| 3,620,330 | A * | 11/1971 | Hall | 181/266 |
| 4,320,815 | A * | 3/1982 | Norris | 181/226 |
| 4,402,485 | A * | 9/1983 | Fagerlund | 251/118 |
| 4,557,349 | A * | 12/1985 | Crump | 181/279 |
| 4,851,015 | A * | 7/1989 | Wagner et al. | 95/15 |
| 5,063,736 | A * | 11/1991 | Hough et al. | 60/286 |
| 5,280,143 | A * | 1/1994 | Kakuta | 181/250 |
| 5,293,742 | A * | 3/1994 | Gillingham et al. | 60/288 |
| 5,388,408 | A * | 2/1995 | Lawrence | 60/324 |
| 5,739,484 | A * | 4/1998 | Jones | 181/264 |
| 6,571,910 | B2 * | 6/2003 | Storm | 181/264 |
| 6,598,390 | B2 * | 7/2003 | Chang | 60/323 |
| 7,243,757 | B2 * | 7/2007 | Stuber | 181/270 |
| 7,549,511 | B2 * | 6/2009 | Marocco | 181/270 |
| 7,549,512 | B2 * | 6/2009 | Newberry | 181/281 |
| 7,775,322 | B2 * | 8/2010 | Hill | 181/254 |
| 2002/0175022 | A1 * | 11/2002 | Schumacher et al. | 181/254 |
| 2006/0000205 | A1 * | 1/2006 | Bozmoski et al. | 60/324 |
| 2006/0054381 | A1 * | 3/2006 | Takemoto et al. | 181/237 |
| 2006/0249328 | A1 * | 11/2006 | Ichikawa et al. | 181/254 |
| 2006/0272322 | A1 * | 12/2006 | Abram et al. | 60/324 |
| 2008/0314679 | A1 * | 12/2008 | Rowe et al. | 181/241 |

FOREIGN PATENT DOCUMENTS

| | | |
|---|---|---|
| JP | 09088568 | 3/1997 |
| JP | 10159547 | 6/1998 |
| WO | WO 2004/059134 | 7/2004 |

OTHER PUBLICATIONS

International Written Opinion dated Aug. 31, 2007, for corresponding application PCT/AU2007/001110.

International Preliminary Report on Patentability dated Oct. 31, 2008, for corresponding application PCT/AU2007/001110.

European Patent Office, Extended European Search Report for Application No. 07784750.7-2321, dated Nov. 29, 2011, 7 pages, Germany.

Intellectual Property Office of New Zealand, Examination Report for Patent Application No. 574642, dated Mar. 28, 2012, 2 pages, New Zealand.

* cited by examiner

MUFFLER ASSEMBLY

FIELD OF THE INVENTION

The present invention relates to muffler assemblies.

The invention has been developed primarily as a muffler assembly for use in a motor vehicle and will be described hereinafter with reference to this application. However, it will be appreciated that the invention is not limited to this particular field of use.

BACKGROUND OF THE INVENTION

The following discussion of the prior art is intended to place the invention in an appropriate technical context and enable the associated advantages to be fully understood. However, any discussion of the prior art throughout the specification should not be considered as an admission that such art is widely known or forms part of the common general knowledge in the field.

Currently in the automotive exhaust industry, there are only a few options available for exhaust systems on vehicles.

One option is the standard exhaust system utilising a standard muffler. This system provides a medium amount of backpressure to the engine and sufficient amount of sound reduction in order for the motor vehicle to satisfy relevant noise emission regulations. However, it is known for this type of exhaust system to restrict the engine's efficiency at higher engine speeds and consequently may be restrictive during performance driving.

Another type of exhaust system available is the performance exhaust system. In this system a performance muffler is used to provide minimal backpressure and sound reduction. Therefore these types of systems are ideal for internal combustion engines operating at higher engine speeds. Vehicles with this type of muffler are predominantly used in performance driving or racing and are typically considerably louder than standard exhausts. This in turn, limits their drivability on public roads.

In order to have the benefits of both the abovementioned systems, it is known to have both the standard and performance muffler installed on a single motor vehicle. In such an arrangement, the exhaust piping from the engine is split into two separate steams, which in turn are connected to each of the mufflers. Typically, a selectable control valve is installed at the split junction to control exhaust gas flow to both mufflers.

Whilst this arrangement provides the benefits of both systems, it requires a significant amount of specialist installation and therefore, may be a relatively expensive option. Moreover, since many newer vehicles are designed with smoother under vehicle area to reduce aerodynamic drag, space under the vehicle is limited and therefore such systems are generally not suitable simply because there is not enough space available.

It is an object of the present invention to overcome or ameliorate at least one of the disadvantages of the prior art, or to provide a useful alternative.

It is an object of a preferred form of the invention to provide a relatively inexpensive to install exhaust system that affords the benefits of both a standard and performance exhaust system, whilst generally occupying the same space as a standard system.

SUMMARY OF THE INVENTION

Accordingly, there is provided a muffler assembly for exhaust gas flow communication with an engine exhaust, the assembly including:

a muffler having inlet and outlet ports, first and second flow of passages in common fluid communication with the outlet port and in variable fluid communication with the inlet port, the first and second flow passages meeting at first and second connecting points, the first connecting point being located in the proximity of the inlet port, the first flow passage having a higher resistance to fluid flow than the second flow passage; and a valve means generally located past the first connecting point inside the second flow passagefor selectively proportionating exhaust gases passing through the passages, the first flow passageincluding three or more conduits being in fluid communication with each other.

The second connecting point may be located in the proximity of the outlet port.

In a preferred embodiment the valve means is located in the proximity of but precedes the second connecting point.

Preferably the conduits are circumferentially disposed, axially extending and equidistantly spaced. More preferably, one of the conduits is in fluid communication with the inlet port at the first connecting point. Even more preferably, another one of the conduits is in fluid communication with the outlet port at the second connecting point.

The muffler assembly preferably includes a proximal and a distal substantially annular cavity disposed at respective ends of the muffler. More preferably, each annular cavity is in fluid communication with at least two of the conduits.

Preferably, the second flow passage includes a central conduit in fluid communication with the outlet port and in variable fluid communication with the inlet port.

A sound attenuation zone is preferably disposed intermediate the proximal and distal annual cavities. Preferably, the sound attenuation zone includes a sound dampening material isolating the conduits from one another. More preferably, all of the conduits are substantially perforated in the sound attenuation zone.

Preferably, the valve means is a butterfly valve. More preferably, the muffler assembly includes a valve control means associated with the valve for operating the valve. Even more preferably, the valve control means includes a linear actuator adapted to rotate the butterfly valve. In a preferred form the muffler assembly includes a remote controlling means adapted for operating the valve control means.

Alternatively the valve actuating means may be controlled by a triggering mechanism which may include a detector adapted to be attached to a spark plug lead for detecting an ignition frequency and hence a rate of revolution of an engine. The detector may be designed to transmit a signal to activate the valve actuating means at an adjustable predetermined ignition frequency.

Preferably, the muffler assembly includes a power supply for suppling power to the valve control means. More preferably, the power supply is a power plug engagable with a 12V power source. Even more preferably, the 12V power source is an automotive cigarette lighter socket.

BRIEF DESCRIPTION OF THE DRAWINGS

A preferred embodiment of the invention will now be described, by way of example only, with reference to the accompanying drawings in which.

DESCRIPTION OF THE PREFERRED EMBODIMENT

Referring to the accompanying drawings, there is provided a muffler assembly 10 for exhaust flow communication with an internal combustion engine. It is proposed that the assembly be installed on a motor vehicle exhaust system (not shown) either as an aftermarket option or as standard equipment.

Figure 1:
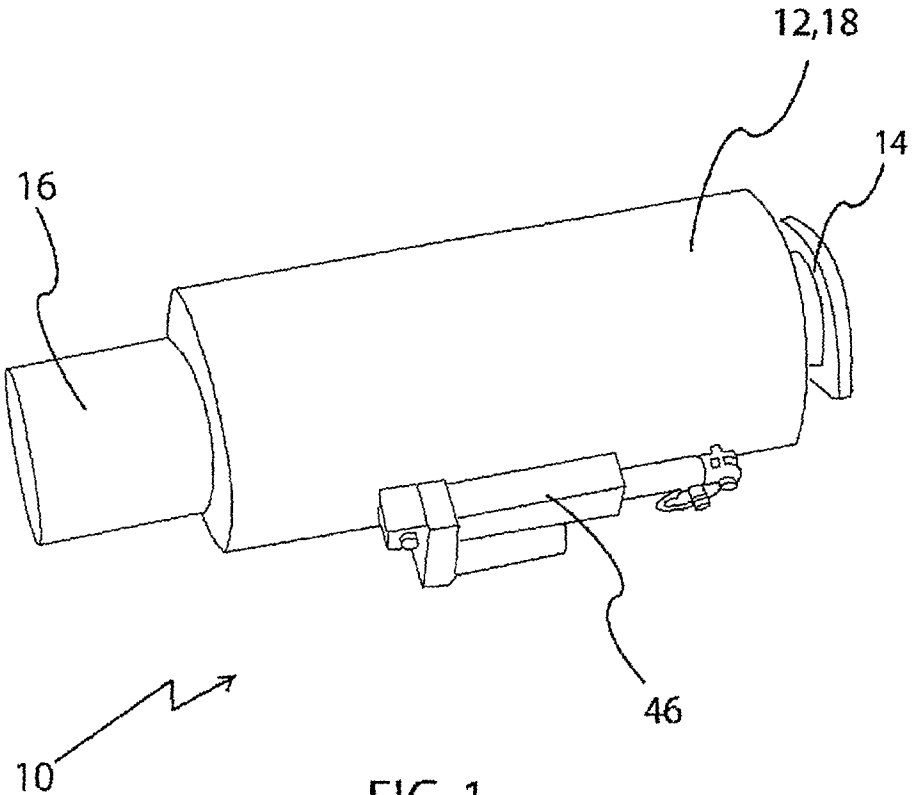
FIG. 1 is a perspective view of a muffler assembly according to the invention.
Figure 2:
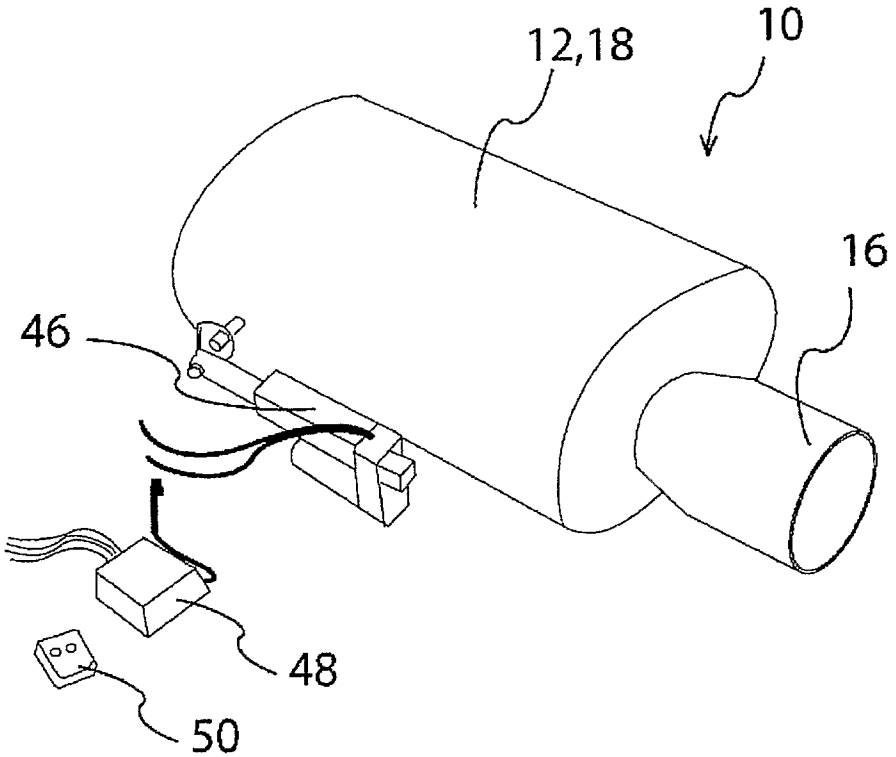
FIG. 2 is another perspective view of the muffler assembly of FIG. 1, showing a control module and remote control.

The assembly includes a muffler 12 having an inlet port 14 for connection to the exhaust of the engine (not shown) and an outlet port 16 for connection to an exhaust pipe (also not shown). As best shown in FIGS. 1 and 2, the muffler has an outer casing 18 with the inlet and outlet ports disposed at respective ends.

Figure 3:
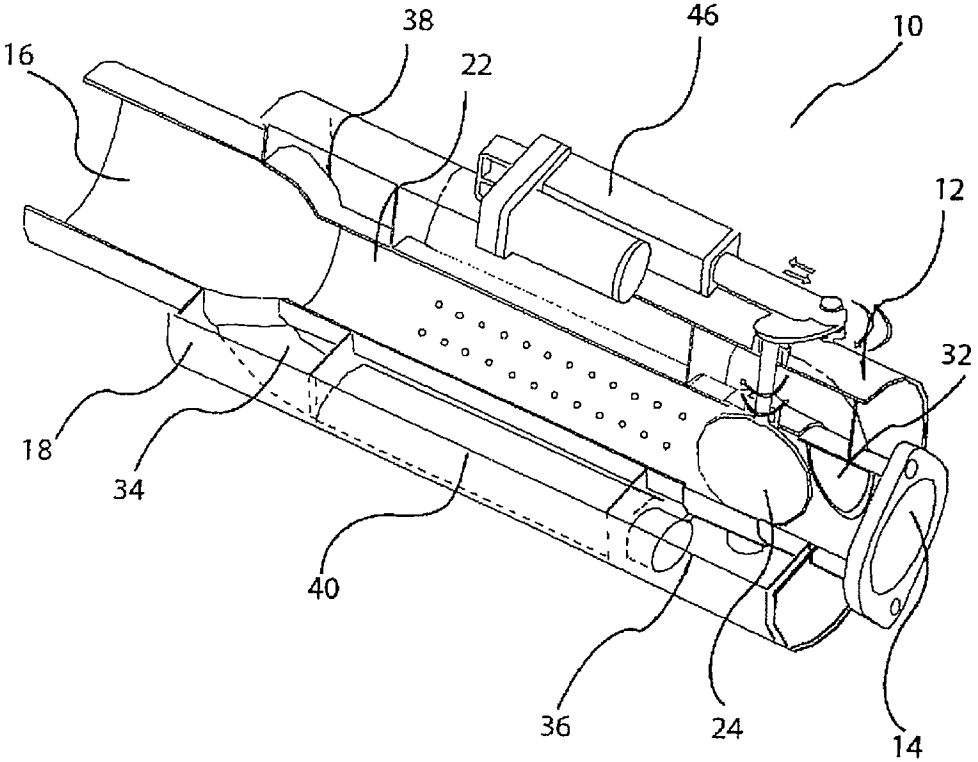
FIG. 3 is a partly cut-away perspective view of the muffler assembly of FIG. 1.
Figure 4:
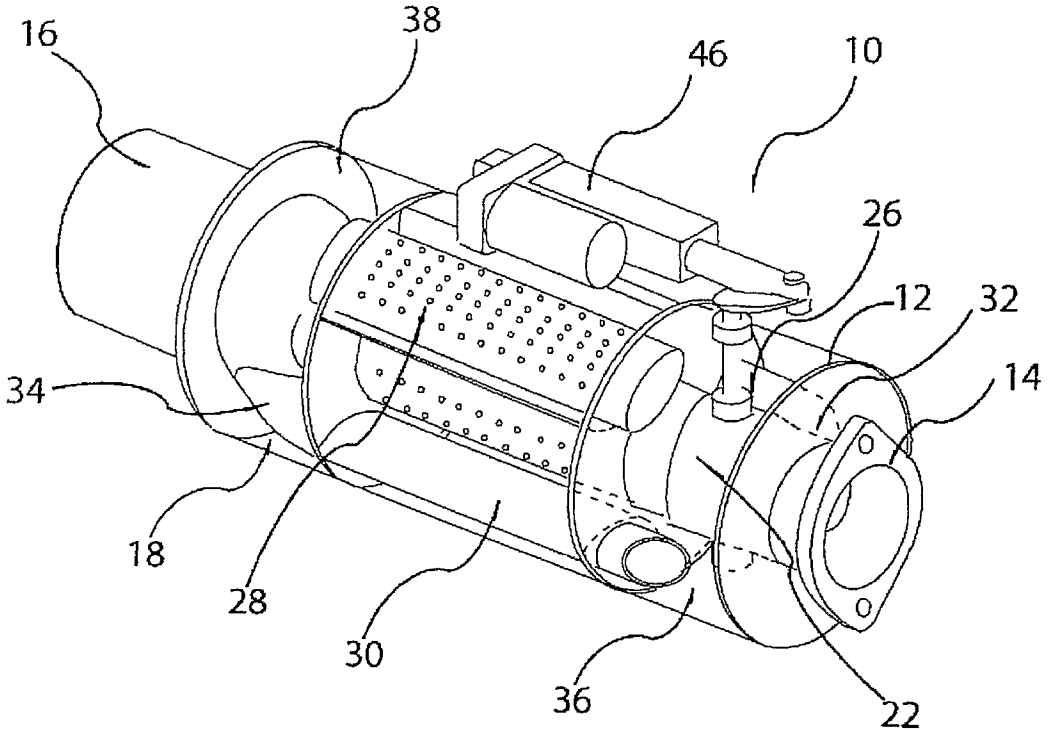
FIG. 4 is another partly cut-away perspective view of the muffler assembly of FIG. 1.

Referring now to FIGS. 3 and 4, three circumferentially disposed, axially extending and equidistantly spaced peripheral conduits, located within the casing, define a first flow path or passage through the muffler. The peripheral conduits include a first, second and third high restriction conduits 26, 28 and 30 in series fluid communication with each other. The first high restriction conduit 26 is in fluid communication with the inlet port 14 through a first arcuate transitional piece 32 and the third high restriction conduit 30 is in fluid communication with the outlet port 16 through a second arcuate transitional piece 34.

The assembly further includes a perforated central conduit 22, which defines a second flow path or passage through the muffler. The arrangement is such that the first and second flow paths or passages are in common fluid communication with the outlet port 16 and in variable fluid communication with the inlet port 14. The first and second passages meet at first and second connecting points, which in the present embodiment are located at the beginning of the first arcuate transitional piece 32 and the end of the second arcuate transitional piece. The first connecting point is located in the proximity of the inlet port 14 while the second connecting point is located in the proximity of the outlet port 16. As such, the sound reduction effect may be optimised. Also, the amount of backpressure and generation of turbulence are likely to be kept to a minimum.

A butterfly valve 24 is located at the entry to the central conduit 22 and is used for selectively varying the relative proportions of the exhaust gas passing through the first and second paths or passages. It is important to note that it is preferred that the butterfly valve 24 is generally located past the first connecting point inside the central conduit 22. Also, even though the butterfly valve 24 in the present embodiment is located at the entry to the central conduit 22, it can be advantageous that the butterfly valve 24 is located in the proximity of but precedes the second connecting point. This in essence provides a further length for the exhaust gas to travel before entering the first high restriction conduit 26. As a result, the engine exhaust sound carried by the exhaust gas may be further reduced.

Proximal and distal annular cavities 36 and 38 are disposed at respective ends of the muffler 12 so as to define intermediate chambers for the peripheral conduits 26, 28, and 30. It will be appreciated that when butterfly valve 24 is closed, exhaust gas flow passes from the inlet port 14 to the first high restriction conduit 26 and into the distal annular chamber 38. The exhaust gas then enters the second high restriction conduit 28 to flow into the proximal annular cavity 36 and in turn, into the third high restriction conduit 30 to eventually exit through the outlet port 16.

A sound attenuation zone 40 is defined between the proximal and distal annular cavities 36 and 38. The sound attenuation zone includes a sound dampening material 42 to absorb a substantial portion of the engine exhaust sound carried by the exhaust gas. As such, the sound dampening material 42 isolates the conduits 26, 28 and 30 from one another. For this reason, the conduits include perforations 44 for conducting the exhaust sound into the sound dampening material.

Figure 5:
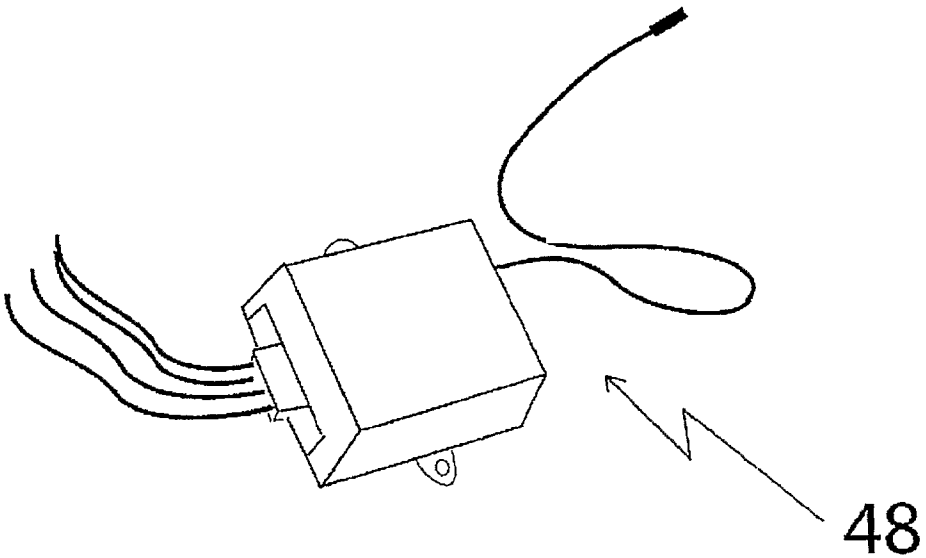
FIG. 5 is a perspective view of the control module of FIG. 2.

As mentioned earlier, a butterfly valve 24 is located at the entry to the central conduit 22. In order to provide rotational positional control of the butterfly valve, the assembly further includes a valve control means, associated with the valve 24, in the form of a linear actuator 46 and actuator control module 48, as best illustrated in FIG. 5. A remote control unit 50 is employed to wirelessly communicate with the control module and thereby operate the linear actuator and the associated valve rotation. Alternatively, in another embodiment, the valve actuating means may be controlled by a triggering mechanism including a detector adapted to be attached to a spark plug lead for detecting an ignition frequency and hence a rate of revolution of an engine. Being located in the vicinity of the spark plug lead, the detector is capable of detecting a magnetic field induced by any occurrence of a current flow through the lead and hence the frequency of the occurrences of current flow. This frequency of occurrences of current flow is basically equivalent to the ignition frequency. The detector may be designed to transmit a signal to activate the valve actuating means at an adjustable predetermined ignition frequency. It should be understood however, that other types of control arrangements, such as hard wiring or computer control might be employed, without departing from the scope of the invention.

Figure 6:
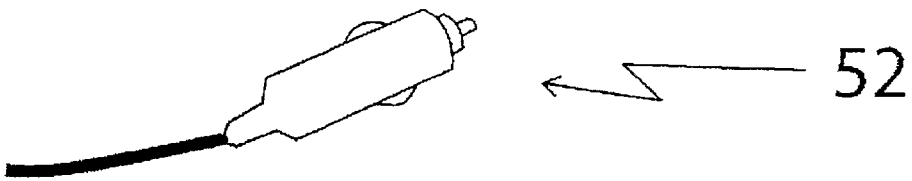
FIG. 6 is a perspective view of a power plus for use with the muffler assembly of FIG. 1.

As best shown in FIG. 6, electrical power is provided to the actuator control module 48 by means of a cable and power plus 52. The power plus is adapted for connection to a 12V supply socket such as a vehicle cigarette lighter socket (not shown), which advantageously simplifies installation and allows for the muffler assembly to be easily moved between vehicles. In an alternative embodiment however, the actuator control module may be hard wired to the power supply of the motor vehicle.

Figure 7:
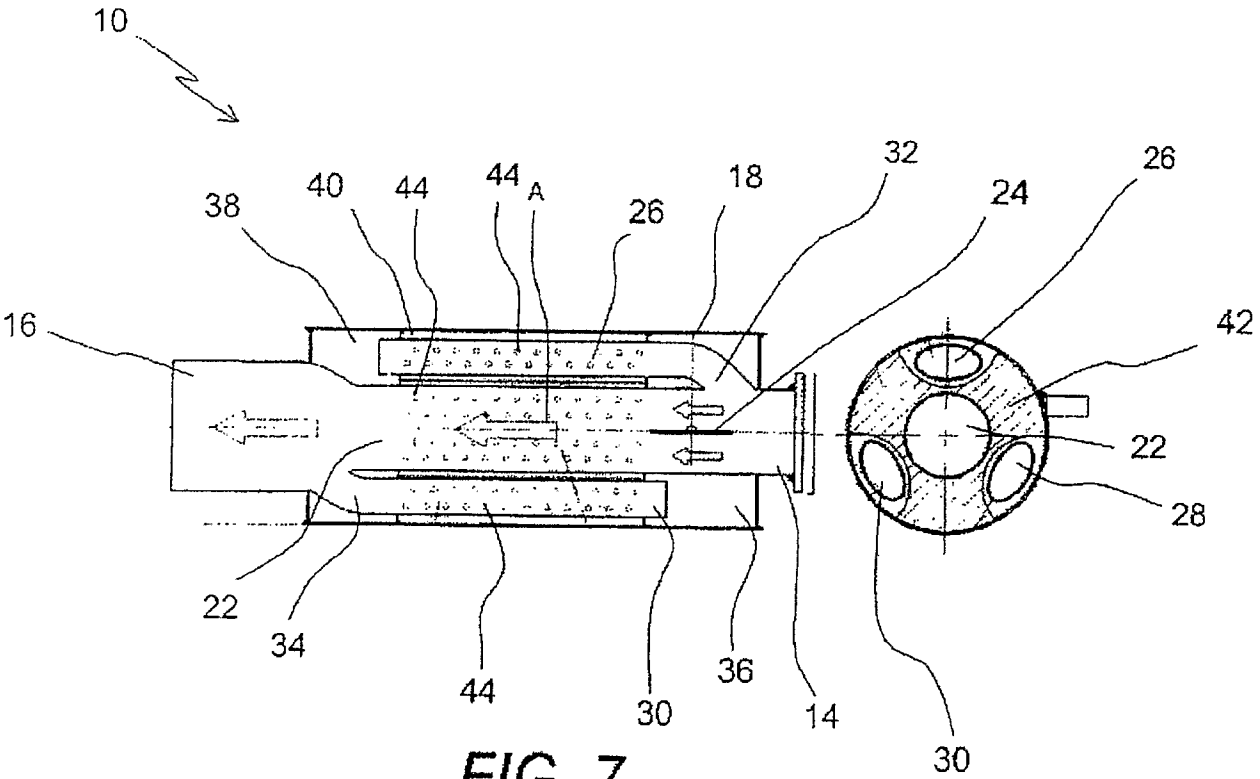
FIG. 7 is cross-sectional view of the muffler assembly of FIG. 1, in a fully open configuration.

With reference to FIG. 7, when the butterfly valve 24 is in the position, the exhaust gas will travel predominantly through the central conduit 22 along a path indicated by arrow A. Whilst there will be some gas that travels into the peripheral conduits 26, 28, and 30, the predominant flow will be along the central conduit due to the larger cross sectional area available.

Advantageously, under these circumstances, an engine connected to the muffler assembly would operate more efficiently at higher engine speeds because of the relatively lower backpressure. In addition, due to exhaust gas mainly being only exposed to the perforations 44 on the central conduit 22, the resulting sound attenuation provided would be relatively minimal. Accordingly, this configuration would be ideal for performance or racing applications.

Figure 8:
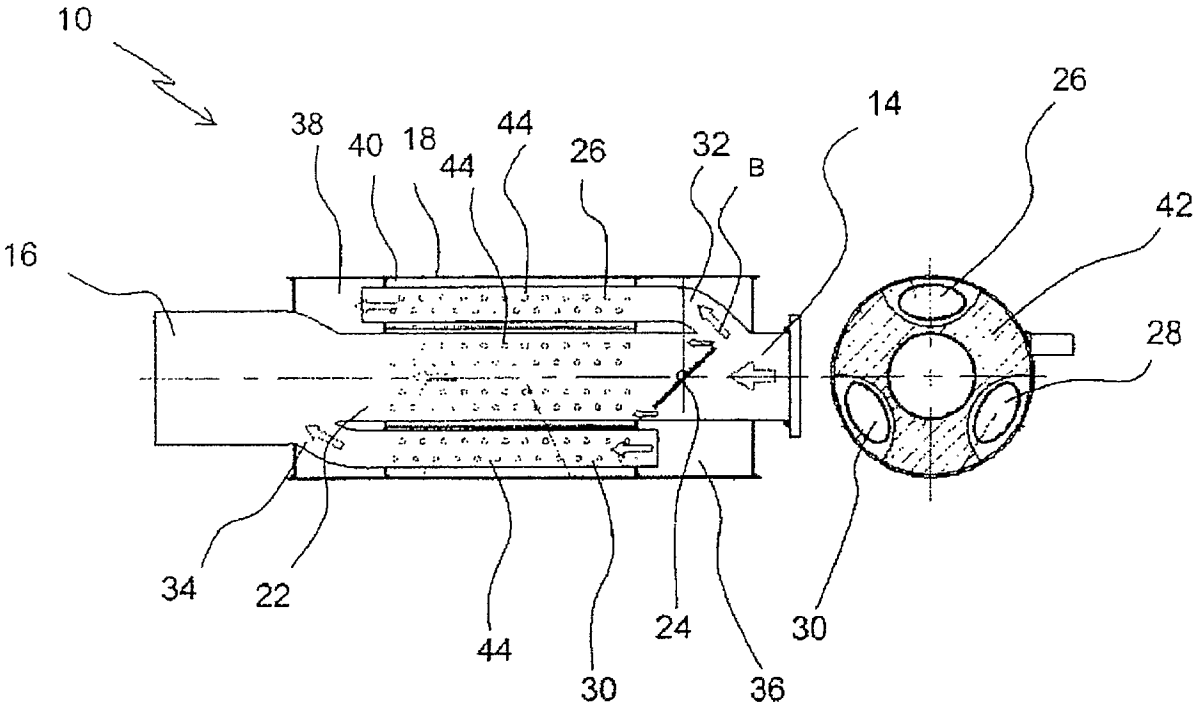
FIG. 8 is cross-sectional view of the muffler assembly of FIG. 1, in a partly open configuration.

In comparison, when the butterfly valve 24 is in the position shown in FIG. 8 the exhaust gas enters the inlet port 14 and a portion is directed into first arcuate transitional piece 32 to enter the first restriction conduit 26 in a direction indicated by arrow B. With the butterfly valve being slightly open however, another portion will also enter the central conduit 22.

As a portion of the gas travels along the peripheral conduits and is exposed to three passes though the sound attenuation area, there will be more sound attenuation in this configuration then in the configuration depicted in FIG. 7. Moreover, this configuration would provide an intermediate level of backpressure to an engine and therefore potentially beneficial at intermediate to higher engine speeds. In this regard, this configuration defines an intermediate restriction level and is ideally suited to intermediate performance applications.

When the butterfly valve 24 is fully closed, the total exhaust gas flow will travel into the peripheral conduits 26, 28, and 30. Under these circumstances, maximum backpressure and sound attenuation is provided and this configuration is ideally suited to lower engine speeds and normal driving applications.

In one preferred form of the invention a display unit, such as a LCD or LED display, is operatively connected to the butterfly valve 24 so as to indicate the angle of the valve. Preferably the display unit is located within the cabin of the vehicle and in position for easy viewing by the driver.

It will be appreciated that the illustrated muffler assembly provides an exhaust system that can act as either a low noise exhaust for normal driving applications, a high noise exhaust system for performance or race applications or an intermediate level noise exhaust system for intermediate performance applications.

Although the invention has been described with reference to specific examples, it will be appreciated by those skilled in the art that the invention may be embodied in many other forms.

INDUSTRIAL APPLICABILITY

The invention has industrial applicability in that it provides a muffler assembly which can give the benefits of both a standard and a performance muffler, without significant added expense, and while generally occupying the same space as a standard system.

The invention claimed is:

1. A muffler assembly for exhaust gas flow communication with an engine exhaust, the assembly comprising:

a muffler having inlet and outlet ports located at opposite ends of the engine exhaust, first and second flow passages in common fluid communication with the outlet port and in variable fluid communication with the inlet port, the first and second flow passages meeting at first and second connecting points, the first connecting point being located in the proximity of the inlet port at one end of the muffler, the second connecting point being located in the proximity of the outlet port at a distal end of the muffler, the first flow passage having a higher resistance to fluid flow than the second flow passage; and a valve means generally located past the first connecting point inside the second flow passage for selectively proportionating exhaust gases passing through the passages, the first flow passage including three or more conduits, wherein the three or more conduits are in series fluid communication with each other and no portion of any one of the three or more conduits is contained within any of the remaining conduits.

2. A muffler assembly as claimed in claim 1, wherein the second connecting point is located in the proximity of the outlet port.

3. A muffler assembly as claimed in claim 1, wherein the valve means is located in the proximity of but precedes the second connecting point.

4. A muffler assembly as claimed in claim 1, wherein the conduits are axially extending and equidistantly spaced.

5. A muffler assembly as claimed in claim 1, wherein one of the conduits is in fluid communication with the inlet port at the first connecting point.

6. A muffler assembly as claimed in claim 5, wherein another one of the conduits is in fluid communication with the outlet port at the second connecting point.

7. A muffler assembly as claimed in claim 1 which includes a proximal and a distal substantially annular cavity disposed at respective ends of the muffler.

8. A muffler assembly as claimed in claim 7, wherein each annular cavity is in fluid communication with at least two of the conduits.

9. A muffler assembly as claimed in claim 1, wherein the second flow passage includes a central conduit in fluid communication with the outlet port and in variable fluid communication with the inlet port.

10. A muffler assembly as claimed in claim 9, wherein the three or more conduits being in fluid communication with each other are circumferentially disposed about the central conduit, axially extending, and equidistantly spaced.

11. A muffler assembly as claimed in claim 1, wherein a sound attenuation zone is disposed intermediate the proximal and distal annular cavities.

12. A muffler assembly as claimed in claim 11, wherein the sound attenuation zone includes a sound dampening material isolating the conduits from one another.

13. A muffler assembly as claimed in claim 11, wherein all of the conduits are substantially perforated in the sound attenuation zone.

14. A muffler assembly as claimed in claim 1, wherein the valve means is a butterfly valve.

15. A muffler assembly as claimed in claim 1, further comprising a valve control means associated with the valve means, the valve control means comprising a linear actuator adapted to rotate the valve means.

16. A muffler assembly as claimed in claim 15, further comprising a power means for supplying power to the valve control means.

17. A muffler assembly as claimed in claim 16, wherein the power means comprises a power plug engagable with a 12V power source.

18. A muffler assembly as claimed in claim 17, wherein the power means comprises an automotive cigarette lighter socket.

19. A muffler assembly as claimed in claim 15, wherein the valve control means is configured to be controlled by a triggering mechanism including a detector configured to be attached to a spark plug lead for detecting an ignition frequency and hence a rate of revolution of an engine.

20. A muffler assembly as claimed in claim 19, wherein the detector is configured to transmit a signal to activate the valve control means at an adjustable predetermined ignition frequency.

* * * * *